US009259917B2

(12) United States Patent
Uchida

(10) Patent No.: US 9,259,917 B2
(45) Date of Patent: Feb. 16, 2016

(54) INKJET RECORDING APPARATUS AND RECORDING POSITION ADJUSTMENT METHOD

(71) Applicant: CANON KABUSHIKI KAISHA, Tokyo (JP)

(72) Inventor: Naoki Uchida, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 57 days.

(21) Appl. No.: 14/103,075

(22) Filed: Dec. 11, 2013

(65) Prior Publication Data

US 2014/0098151 A1 Apr. 10, 2014

Related U.S. Application Data

(62) Division of application No. 13/014,666, filed on Jan. 26, 2011, now abandoned.

(30) Foreign Application Priority Data

Jan. 29, 2010 (JP) ..... 2010-019447

(51) Int. Cl.
*B41J 2/045* (2006.01)
*B41J 29/38* (2006.01)
*B41J 2/21* (2006.01)

(52) U.S. Cl.
CPC ..... *B41J 2/04505* (2013.01); *B41J 29/38* (2013.01); *B41J 2/2135* (2013.01)

(58) Field of Classification Search
CPC ..... B41J 29/393; B41J 25/308; B41J 2/2135; B41J 2/04573; B41J 11/0035; B41J 2/04505; B41J 2/04556; B41J 2/0458; B41J 11/42; B41J 2029/3935
USPC ..... 347/8, 9–12, 14, 19–20, 40, 42, 47, 49
See application file for complete search history.

(56) References Cited

U.S. PATENT DOCUMENTS 6,471,315 B1 * 10/2002 Kurata ..... 347/8
7,237,858 B2 * 7/2007 Igarashi ..... 347/8

* cited by examiner

*Primary Examiner* — Thinh Nguyen
(74) *Attorney, Agent, or Firm* — Canon USA, Inc., IP Division

(57) ABSTRACT

The present invention preferentially sets an adjustment value of a nozzle array having a deviation amount in a conveyance direction which exceeds a threshold amount, and sets the adjustment value in such a manner that the total of deviation amounts of a plurality of nozzle arrays can be minimized.

14 Claims, 18 Drawing Sheets

FIG.4

| | PC | C | Y | M | Pm | R | G | B | PGy | Gy |
|---|---|---|---|---|---|---|---|---|---|---|
| PBk | 1.5 | 1.5 | 1.3 | 1.3 | 1.3 | 0.7 | 0.7 | 0.7 | 0.6 | 0.5 |
| Gy | 1.5 | 1.4 | 1.3 | 1.3 | 1.2 | 0.7 | 0.7 | 0.6 | 0.5 | |
| Pgy | 1.5 | 1.4 | 1.3 | 1.2 | 1.2 | 0.7 | 0.6 | 0.6 | | |
| B | 1.4 | 1.3 | 1.2 | 1.1 | 1.1 | 0.6 | 0.5 | | | |
| G | 1.3 | 1.3 | 1.1 | 1.1 | 1.1 | 0.5 | | | | |
| R | 1.3 | 1.2 | 1.1 | 1.1 | 1.0 | | | | | |
| Pm | 0.8 | 0.7 | 0.6 | 0.5 | | | | | | |
| M | 0.7 | 0.7 | 0.5 | | | | | | | |
| Y | 0.7 | 0.6 | | | | | | | | |
| MBk | 0.6 | 0.5 | | | | | | | | |
| C | 0.5 | | | | | | | | | |

FIG.5

| | PC | C | Y | M | Pm | R | G | B | PGy | Gy |
|---|---|---|---|---|---|---|---|---|---|---|
| PBk | 1.5 | 1.5 | 1.3 | 1.3 | 1.3 | 0.7 | 0.7 | 0.7 | 0.6 | 0.5 |
| Gy | 1.5 | 1.4 | 1.3 | 1.3 | 1.2 | 0.7 | 0.7 | 0.6 | 0.5 | |
| Pgy | 1.5 | 1.4 | 1.3 | 1.2 | 1.2 | 0.7 | 0.6 | 0.6 | | |
| B | 1.4 | 1.3 | 1.2 | 1.1 | 1.1 | 0.6 | 0.5 | | | |
| G | 1.3 | 1.3 | 1.1 | 1.1 | 1.1 | 0.5 | | | | |
| R | 1.3 | 1.2 | 1.1 | 1.1 | 1.0 | | | | | |
| Pm | 0.8 | 0.7 | 0.6 | 0.5 | | | | | | |
| M | 0.7 | 0.7 | 0.5 | | | | | | | |
| Y | 0.7 | 0.6 | | | | | | | | |
| MBk | 0.6 | 0.5 | | | | | | | | |
| C | 0.5 | | | | | | | | | |

FIG.6

| | PC | C | Y | M | Pm | R | G | B | PGy | Gy |
|---|---|---|---|---|---|---|---|---|---|---|
| PBk | 1.4 | 1.0 | 1.3 | 0.8 | 1.3 | 1.0 | 1.0 | 0.9 | 0.6 | 0.9 |
| Gy | 1.5 | 1.0 | 1.3 | 0.8 | 1.2 | 0.7 | 0.7 | 0.6 | 0.5 | |
| Pgy | 1.5 | 1.4 | 1.3 | 1.2 | 1.2 | 0.7 | 0.6 | 0.6 | | |
| B | 1.4 | 0.8 | 1.2 | 0.6 | 1.1 | 0.6 | 0.5 | | | |
| G | 1.3 | 0.8 | 1.1 | 0.6 | 1.1 | 0.5 | | | | |
| R | 1.3 | 0.8 | 1.1 | 0.6 | 1.0 | | | | | |
| Pm | 0.8 | 0.7 | 0.6 | 0.5 | | | | | | |
| M | 0.7 | 0.7 | 0.5 | | | | | | | |
| Y | 0.7 | 0.6 | | | | | | | | |
| MBk | 0.6 | 0.5 | | | | | | | | |
| C | 0.5 | | | | | | | | | |

INKJET RECORDING APPARATUS AND RECORDING POSITION ADJUSTMENT METHOD

CROSS REFERENCE OF RELATED APPLICATIONS

This application is a Divisional of U.S. patent application Ser. No. 13/014,666 filed on Jan. 26, 2011 which claims the benefit of Japanese Patent Application No. 2010-019447 filed Jan. 29, 2010, which is hereby incorporated by reference herein in its entirety.

BACKGROUND OF THE INVENTION

1. Field of the Invention

The present invention relates to an inkjet recording apparatus which records an image on a recording medium by discharging ink from a recording head thereof, and a recording position adjustment method therefor.

2. Description of the Related Art

Conventionally, as a technique used in an inkjet recording apparatus, there has been known the technique of correcting a deviation of a dot-recorded position (a position where an ink droplet is placed) on a recording medium. Japanese Patent Application Laid-Open No. 11-240146 discusses the technique for controlling ink discharge timing according to the position of a carriage with a recording heat loaded thereon in a scanning direction, thereby accurately correcting a recording position regardless of where the carriage is located in the scanning position even when there is a variation in the distance between the carriage and the recording medium in the scanning direction.

However, an amount of deviation of ink droplet impact position varies within the scanning range of the carriage not only in a case of deviations in the scanning direction but also in a case of deviations in the direction intersecting the scanning direction (conveyance direction). One of the causes thereof is, for example, a change in the posture of the carriage during the scanning operation.

FIG. 15 schematically illustrates a change in the posture of the carriage. FIG. 15 illustrates a main rail 8, a sub rail 6, a carriage 4, a recording head 1, and a recording position deviation 23. For example, if the main rail 8 is slightly crooked, the carriage 4 in one position has such a posture that the carriage 4 is inclined relative to a platen as indicated by the diagonal line, while the carriage 4 in another position has such a posture that the carriage 4 is in parallel with the platen. The recording head 1 loaded on the carriage 4 includes a plurality of nozzle arrays arranged at different positions in the scanning direction. When the respective nozzle arrays record dots on a same position on a recording medium, their discharge timing varies for each nozzle array by a time corresponding to the distance between the nozzle arrays and the carriage scanning speed. This means that the carriage is located at different positions in the scanning direction when two nozzle arrays discharge ink to record dots on the same position on the recording medium and the carriage may have different postures at each discharge timing. In this way, the different postures of the carriage result in a deviation in the conveyance direction as to dot-recorded positions which are supposed to be a same position.

A deviation of an impact position in the scanning direction can be corrected by adjustment of the discharge timing, and therefore it is possible to set adjustment values for respective positions within the scanning range. However, for correcting a deviation of an impact position in the conveyance direction, either data should be shifted in the conveyance direction or the nozzle use range should be changed, therefore it is desirable to use one adjustment value to keep the impact position deviation within the required accuracy range throughout the entire scanning range.

When an impact position deviation in the conveyance direction is adjusted at a recording apparatus equipped with a recording head with three or more nozzle arrays formed thereon, a specific nozzle array is set as a reference array, and an adjustment value is applied to each of other nozzles. For example, it is assumed that there is a reference nozzle array, and a nozzle array A and a nozzle array B are the other nozzle arrays. In this case, optimal adjustment of the impact position of the nozzle array A in the conveyance direction relative to the reference nozzle array may result in a further increased deviation between the impact positions of the nozzle arrays A and B. However, the deviation between the nozzle arrays A and B may have a greater influence on the image than the deviation between the reference nozzle array and the nozzle array A. In this case, the adjustment value to the deviation between the nozzle arrays A and B should be preferentially optimally set. Therefore, when adjustment values for nozzle arrays are determined at a recording apparatus equipped with three or more nozzle arrays, the adjustment values should be determined in consideration of the priority order of those nozzle arrays.

SUMMARY OF THE INVENTION

The present invention is directed to a recording apparatus and a recording position adjustment method capable of setting adjustment values for adjusting deviations of impact positions in a conveyance direction to a plurality of nozzle arrays so as to reduce a deviation amount as a whole in each nozzle array throughout a scanning range and adjust the impact positions.

According to an aspect of the present invention, an inkjet recording apparatus is configured to perform recording by driving a recording head, at which a plurality of nozzle arrays for discharging ink are arranged in a predetermined direction, to perform scanning in a scanning direction while conveying a recording medium in a direction which intersects the predetermined direction. The inkjet recording apparatus includes an acquisition unit configured to acquire a deviation amount of a recording position in the intersecting direction for each of the plurality of nozzle arrays, at a plurality positions in the predetermined direction, a determination unit configured to compare the acquired deviation amount of the recording position of each nozzle array with a threshold value to determine a nozzle array exceeding the threshold value, and a setting unit configured to preferentially set an adjustment value for adjusting the recording position of the nozzle array exceeding the threshold value.

According to the present invention, in a recording apparatus using a recording head with a plurality of redundant chips (nozzle arrays), it is possible to prevent overlapping of the regions where dots are recorded with the redundant portions of the colors, thereby reducing occurrence of density nonuniformity.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 4 illustrates an impact position deviation profile of each color.

FIG. 5 illustrates the impact position deviation profile with threshold values applied thereto.

FIG. 6 illustrates impact deviations of each color after adjustment according to the priority is performed.

DESCRIPTION OF THE EMBODIMENTS

Various exemplary embodiments, features, and aspects of the invention will be described in detail below with reference to the drawings.

Figure 1:
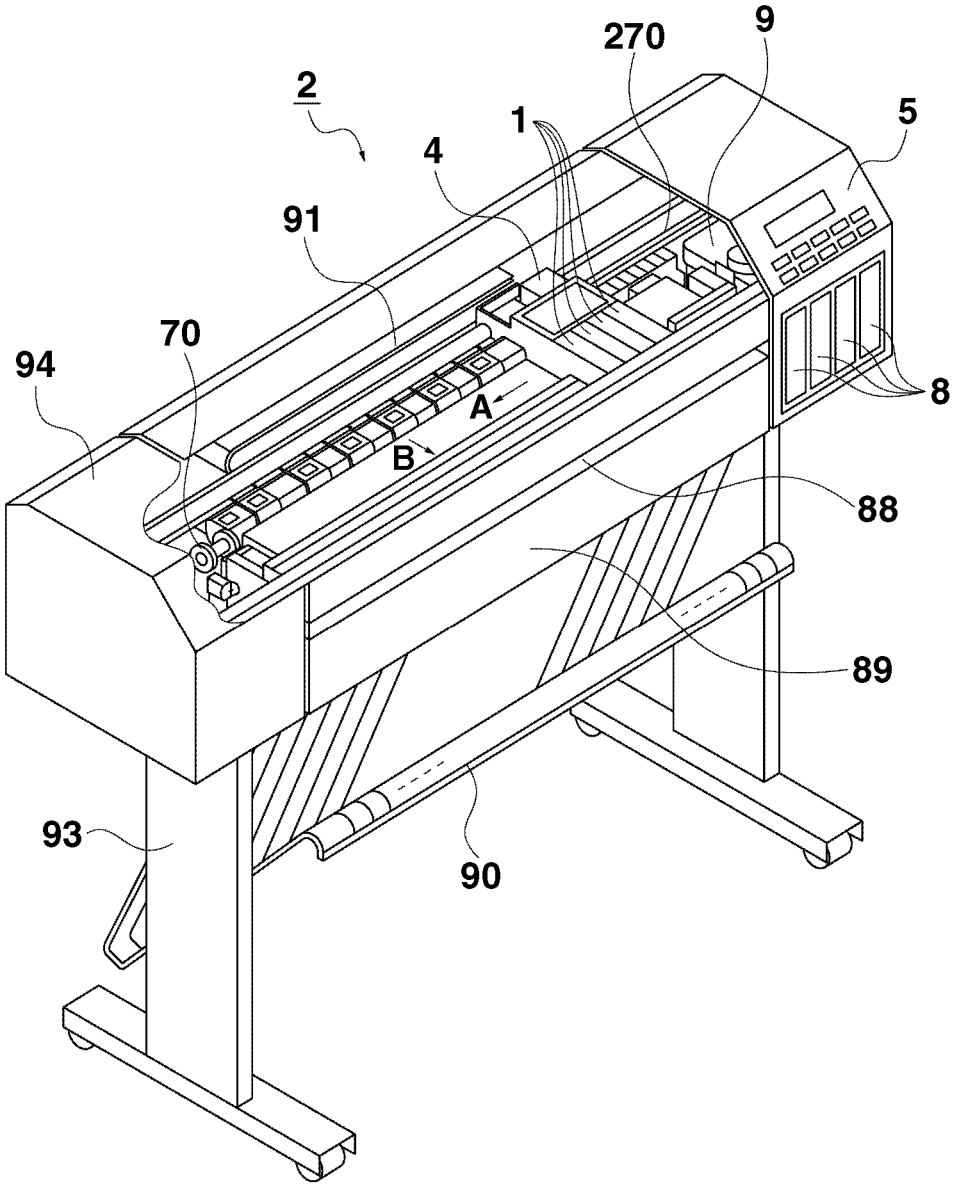
FIG. 1 is a perspective view illustrating an inkjet recording apparatus to which an exemplary embodiment of the present invention can be applied.

FIG. 1 is a perspective view illustrating the appearance of an inkjet recording apparatus to which an exemplary embodiment of the present invention can be applied. The inkjet recording apparatus (hereinafter also simply referred to as "recording apparatus") 2 includes a manual feed insertion port 88 disposed on its front face, and a roll paper cassette 89 disposed below the manual feed insertion port 88 capable of opening frontward and closing backward. Further, a recording medium such as recording paper is fed from the manual feed insertion port 88 or the roll paper cassette 89 into the recording apparatus 2. The inkjet recording apparatus 2 includes an apparatus body 94 supported by two legs 93, a stacker 90 where discharged recording media are stacked, and a transparent openable/closable upper cover 91 that provides inner visibility. Further, the inkjet recording apparatus 2 includes an operation panel 5, an ink supply unit, and an ink tank arranged at the right side of the apparatus body 94.

The recording apparatus 2 further includes a carriage 4 guided and supported so that the carriage 4 can perform reciprocal scanning in a width direction (the direction indicated by the arrow A, scanning direction) of a recording medium which corresponds to a predetermined direction, and a conveyance roller 70 for conveying a recording medium such as recording paper in the direction indicated by the arrow B (conveyance direction) which intersects the predetermined direction. Further, the recording apparatus 2 includes a carriage motor (not illustrated) and a carriage belt (hereinafter referred to as "belt") 270 for reciprocating the carriage 4 in the arrow A direction, and recording heads 1 mounted on the carriage 4. Further, the recording apparatus 2 includes a suction type ink recovery unit 9 for supplying ink and preventing an ink discharge failure which otherwise might be caused by clogging of a discharge port of the recording head 1. Further, a linear scale is disposed in the scanning direction. A relative travel distance of the carriage 4 is detected by counting output pulses of an encoder sensor (not illustrated), and ink discharge timing is controlled based on this information.

In this recording apparatus 2, the carriage 4 includes four recording heads 1 each integrally including three colors of ink so as to make twelve colors of ink in total so that the recording apparatus 2 can record data on a recording medium in full color. The recording apparatus 2 configured as mentioned above performs recording, after the conveyance roller 70 conveys the recording medium to a predetermined recording start position, by repeating the operation of scanning of the recording heads 1 in a main scanning direction by driving the carriage 4 and the operation of conveyance of a recording medium in a sub-scanning direction by the conveyance roller 70.

More specifically, the carriage 4 is moved in the arrow A direction illustrated in FIG. 1 by the belt 270 and the carriage motor (not illustrated), thereby executing recording on a recording medium. When the carriage 4 is moved back to a position before the start of the scanning (home position), the conveyance roller 70 conveys the recording medium in the sub-scanning direction (the arrow B direction B illustrated in FIG. 1). Then, the carriage 4 is driven again to perform scanning in the arrow A direction illustrated in FIG. 1, thereby recording data such as an image or a character on the recording medium. After execution of recording corresponding to one recording medium by a repeat of the above-described operations, the recording medium is discharged onto the stacker 90, thereby completing recording corresponding to one recording medium.

Further, the carriage 4 includes a reflection type optical sensor 30 (not illustrated), which functions to detect a density of an adjustment pattern recorded on a recording medium (sheet) in order to detect a deviation of a recording position. Combining the scanning of the carriage 4 in the scanning direction and the sheet conveyance operation in the sub-scanning direction enables the optical sensor 30 to detect the density of the adjustment pattern recorded on the sheet. The reflection type optical sensor 30 may be used for detecting an end of a sheet.

Figure 2:
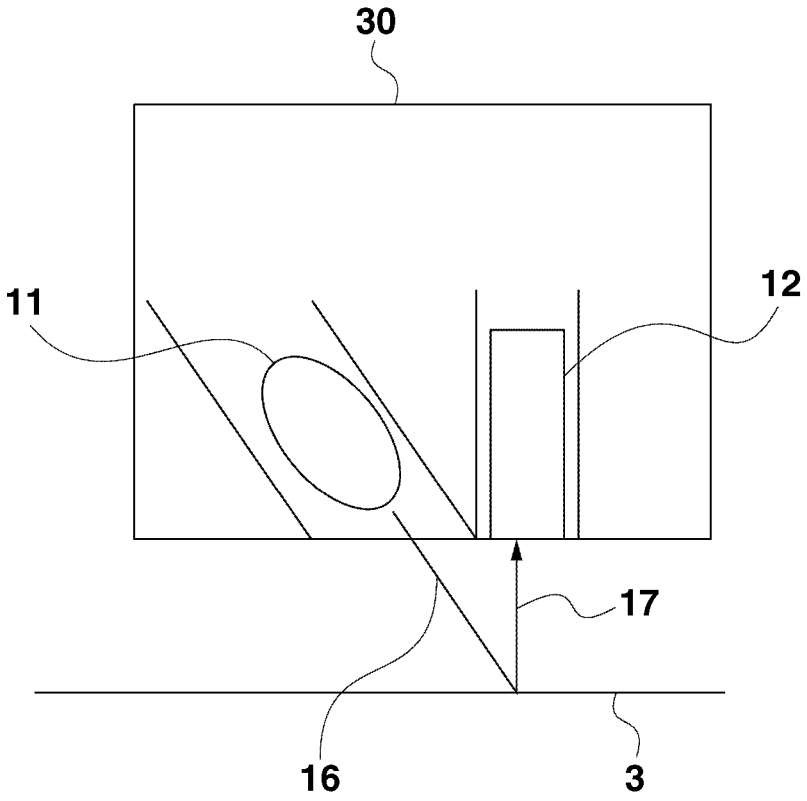
FIG. 2 is a schematic diagram illustrating a reflection type optical sensor.

FIG. 2 is a schematic diagram illustrating the reflection type optical sensor 30 corresponding to an optical detection unit. The reflection type optical sensor 30 includes a light emitting unit 11 and a light receiving unit 12, and is used to detect optical information of an object. Iin 16, which is light emitted from the light emitting unit 11, is reflected on the surface of a recording medium 3. There are specular reflection light and irregular reflection light, as reflected light. It is desirable to detect irregular reflection light Iref 17 to further accurately detect the density of an image recorded on the recording medium 3. Therefore, the light receiving unit 12 is disposed so as to be situated at a different position from the incident angle of light coming from the light emitting unit 11. A detected and acquired detection signal is transmitted to an electric substrate of the recording apparatus 2.

In the present exemplary embodiment, it is assumed that a white light-emitting diode (LED) or 3-color LED is used as the light emitting unit 11, and a photodiode having sensitivity in a visible light region is used as the light receiving unit 12 so that registration adjustment can be performed for the heads which discharge all ink including main ink such as cyan (C), magenta (M), yellow (Y), and black (K), and special color ink. However, for adjustment of nozzle arrays of different kinds of ink in a case of detecting the relationship between their relative recording positions and the density of dots recorded in a superimposed manner, it is more preferable to use a 3-color LED that enables selection of a color having high detection sensitivity. As will be described in more detail later, for detection of the density of an image recorded on the recording medium 3, the sensor 30 does not have to detect an absolute value of the density, but only has to detect the relative density. Further, the sensor 30 may have any degree of detection resolution as long as the detection resolution is sufficient to enable detection of the relative density difference in each pattern (also referred to as "patch") belonging to an adjustment pattern group which will be described later.

Further, a detection system including the reflection type optical sensor 30 may have any degree of stability as long as the detection system is stable enough to have no influence on the detection density difference until a completion of the detection of the adjustment pattern group. At the time of the sensitivity adjustment, for example, the optical sensor 30 is moved to an unrecorded portion of a sheet. As a sensitivity adjustment the light emission intensity of the light emitting unit 11 is adjusted, or a gain of a detection amplifier is adjusted in the light receiving unit 12, so as to realize the detection level of an upper limit value. While not essential, the sensitivity adjustment is preferable for increasing the detection accuracy by improving the signal/noise (S/N) ratio.

Desirably, the space resolution of the reflection type optical sensor 30 is set to a level that enables detection of an area smaller than a recording area of one adjustment pattern. In multipass recording that completes recording of a predetermined area by performing recording and scanning a plurality of times, when adjustment pattern groups are recorded in such a manner that two pattern groups can be adjacent to each other in the respective scanning direction and sub-scanning direction, a recording width of the sub-scanning direction is reduced according to the number of passes. Therefore, the sensor resolution is limited by the number of recording passes. The number of recording passes (recording width) may be determined based on the sensor resolution. Further, a change in the distance between a recording medium and the reflection type optical sensor 30 causes a change in the amount of light received by a phototransistor, thereby enabling detection of the distance between a recording medium and the carriage 4 (corresponding to the distance between a recording medium and the recording head).

Figure 12:
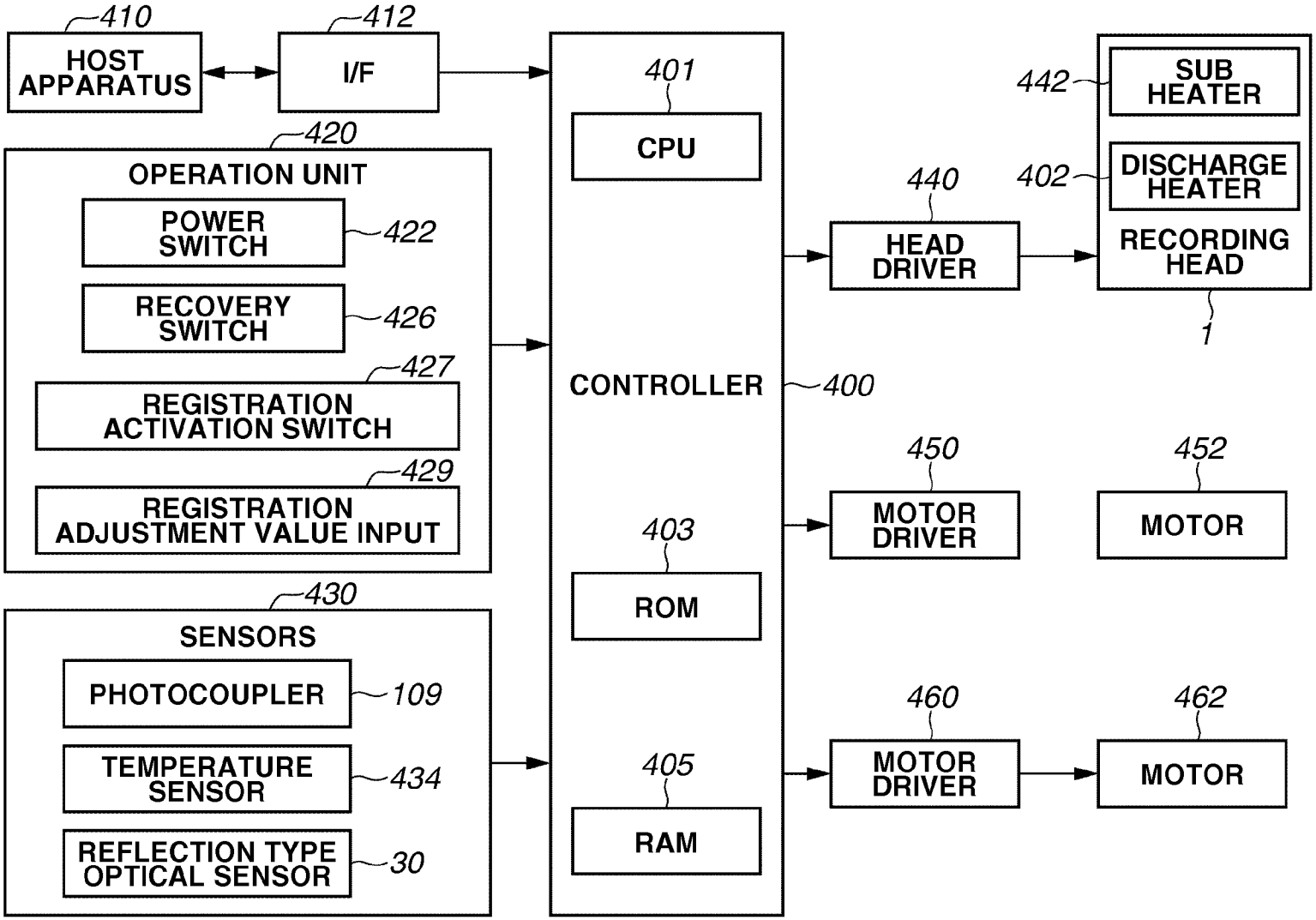
FIG. 12 is a block diagram schematically illustrating a control circuit of the recording apparatus illustrated in FIG. 1.

FIG. 12 is a block diagram schematically illustrating a control circuit of the recording apparatus 2. A controller 400 is a main control unit, and includes: for example, a central processing unit (CPU) 401 in the form of a microcomputer; a read-only memory (ROM) 403 for storing a program, a required table, and other fixed data; and a random access memory (RAM) 405 including, for example, an area used in rasterization of image data or a working area. A host apparatus 410 is a supply source of image data. More specifically, the host apparatus 410 may be in the form of, for example, a computer that generates or processes data such as an image relating to image recording, or a reader for image reading. Image data, other commands, status signals, and the like are transmitted and received between the host apparatus 410 and the controller 400 via an interface (I/F) 412. An operation unit 420 is a group of switches for receiving operator's instruction inputs. The operation unit 420 includes a power switch 422 and a recovery switch 426 for instructing a start of suction recovery. The operation unit 420 further includes, for example, a registration adjustment activation switch 427 for performing manual registration adjustment, and a registration adjustment value setting input unit 429 for manually inputting an adjustment value. A sensor group 430 is a group for detecting a state of the apparatus, and includes, for example, the above-described reflection type optical sensor 30, a photocoupler 109 for detecting a home position, and a temperature sensor 434 disposed at an appropriate place for detecting an ambient temperature.

Ahead driver 440 is a driver for driving a discharge heater in the recording head 1 according to, for example, print data. The head driver 440 includes a shift register for arranging print data so as to correspond to the position of the discharge heater, and a latch circuit for performing latching at appropriate timing. The head driver 440 further includes, for example, a logical circuit element for actuating the discharge heater in synchronization with a driving timing signal, and a timing setting unit for appropriately setting driving timing (discharge timing) for adjustment of a dot recording position.

Figure 7:
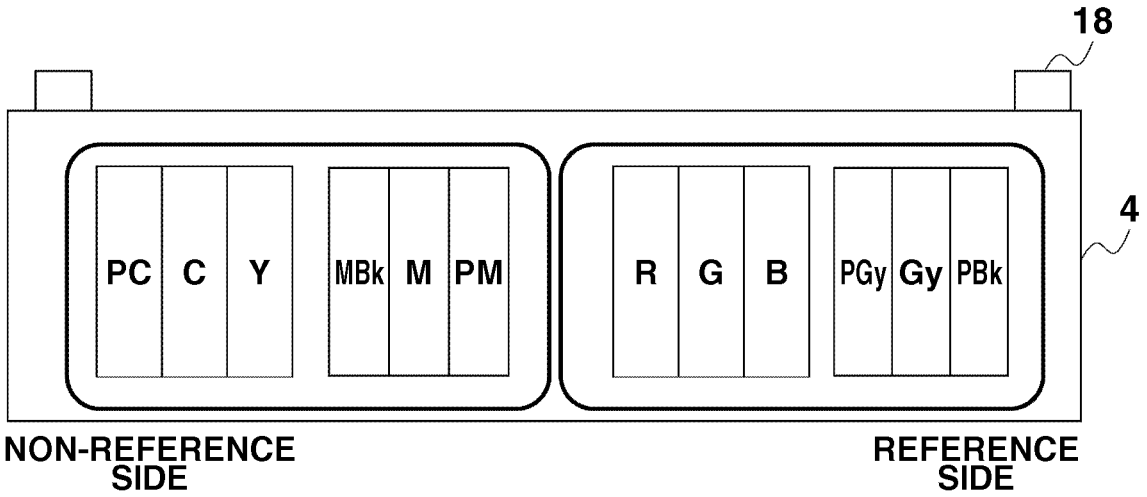
FIG. 7 illustrates a structure of a recording head to which the exemplary embodiment of the present invention can be applied.

FIG. 7 illustrates an arrangement of nozzle arrays of twelve colors in the present exemplary embodiment. The present exemplary embodiment uses recording heads which are detachably attached to the carriage 4, and each include three colors integrally. The recording heads are attached to the carriage 4 so as to establish the arrangement {photo black (PBk), gray (Gy), photo gray (PGy)}, {blue (B), green (G), red (R)}, {photo magenta (PM), magenta (M), matte black (MBk)}, {yellow (Y), cyan (C), photo cyan (PC)} from the reference side in this order.

Figure 3:
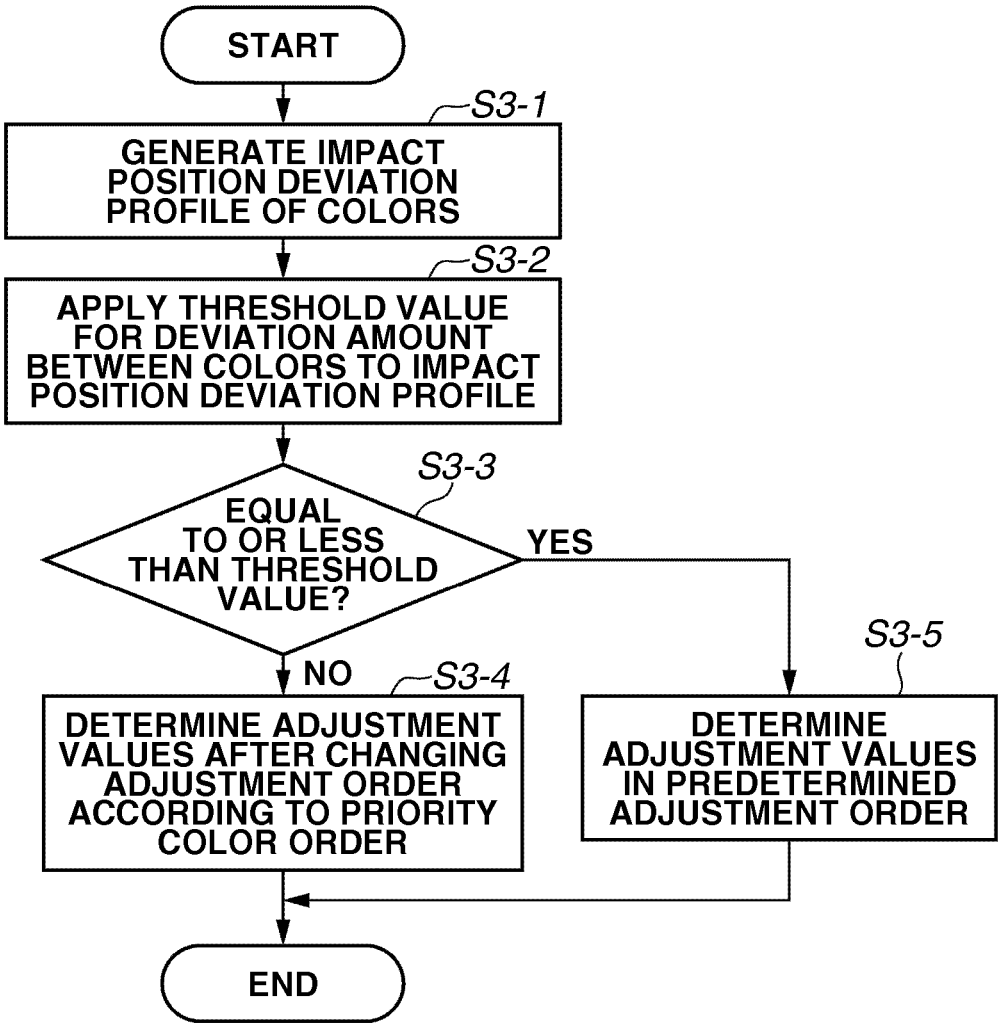
FIG. 3 is a representative flowchart of the exemplary embodiment of the present invention.

Hereinafter, the recording position adjustment method according to the present exemplary embodiment will be described in detail. FIG. 3 is a flowchart illustrating the recording position adjustment method according to the present exemplary embodiment. The processing according to this flow can be executed at any timing such as at the time of start-up of the recording apparatus 2 for the first time, or at the time of user's issuance of an instruction through an input unit of the host apparatus 410 or the recording apparatus 2. First, in step S3-1, the controller 400 of the recording apparatus 2 generates an impact position deviation profile of the colors. Normally, this impact position deviation profile is formed by acquiring impact position deviations in the conveyance direction with respect to all combinations of the twelve colors. However, in this description, it is assumed that deviations with respect to the combinations relating to MBk are not acquired. This is because PBk and MBk are black colors to be switched therebetween to be used according to a usage purpose (mode), and the present exemplary embodiment will be described based on an example of generating the impact position deviation profile under the condition (mode) using no MBk.

Next, the method of acquiring impact position deviations of the colors by generating test patterns will be described. If adjustment values are acquired by generating test patterns throughout the entire region in the scanning direction with respect to each of all combinations of the eleven colors, this will require a large number of recoding media and a great deal of time. Therefore, instead of that, the present exemplary embodiment employs the following method which enables easier acquisition of the adjustment values.

Figure 9:
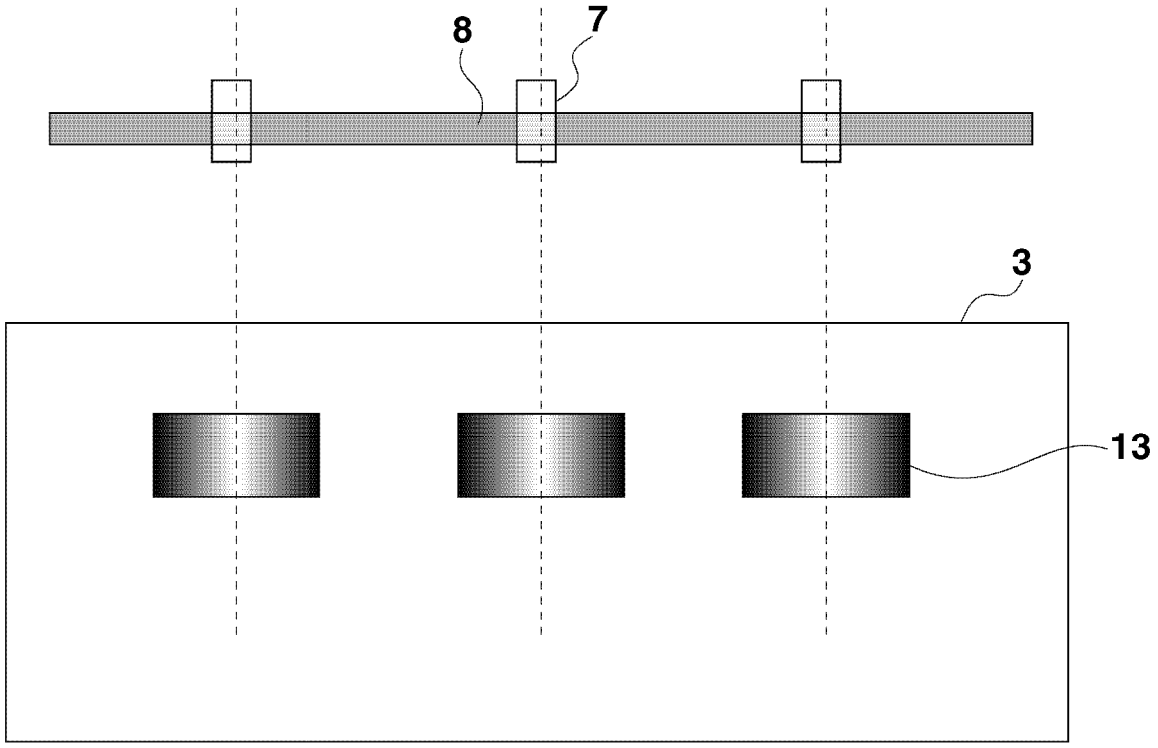
FIG. 9 illustrates patterns for acquiring an impact position deviation based on an inflection point.

FIG. 9 illustrates test patterns in the present exemplary embodiment. Referring to FIG. 9, the main rail 8 is supported by main rail support members 7. The not-illustrated carriage 4 performs scanning on the main rail 8, thereby executing recording on a recording medium. In the present exemplary embodiment, adjustment patterns 13 for detection of impact position deviations are recorded at positions of the recording medium 3 corresponding to the main rail support members 7. This is because a change in the posture of the carriage 4 tends to happen at the main rail support member 7. Therefore, impact position deviation amounts throughout the entire carriage scanning region can be estimated by forming adjustment patterns only at positions which tend to cause a change in the posture of the carriage 4, and complementing the impact position deviation amounts between the support members 7 (corresponding to inflection points of change in the deviation amount) with use of linear approximation. The present exemplary embodiment acquires the largest impact position deviation amount out of the impact position deviation amounts throughout the entire scanning region as the deviation amount between the colors.

The adjustment pattern 13 for acquiring an deviation amount in the conveyance direction may be embodied by any of conventionally known various patterns. For example, a deviation amount between two target colors can be acquired by drawing lines with different deviation amounts between the colors in a plurality of stages and obtaining the deviation amount based on the deviation amount when two lines are the closest to forming a straight line. Alternatively, a deviation amount between two target colors can be acquired by forming a plurality of blocks with different deviation amounts between the colors so that the catoptrics density is changed, and obtaining the deviation amount based on the change in the catoptrics density.

Figure 8:
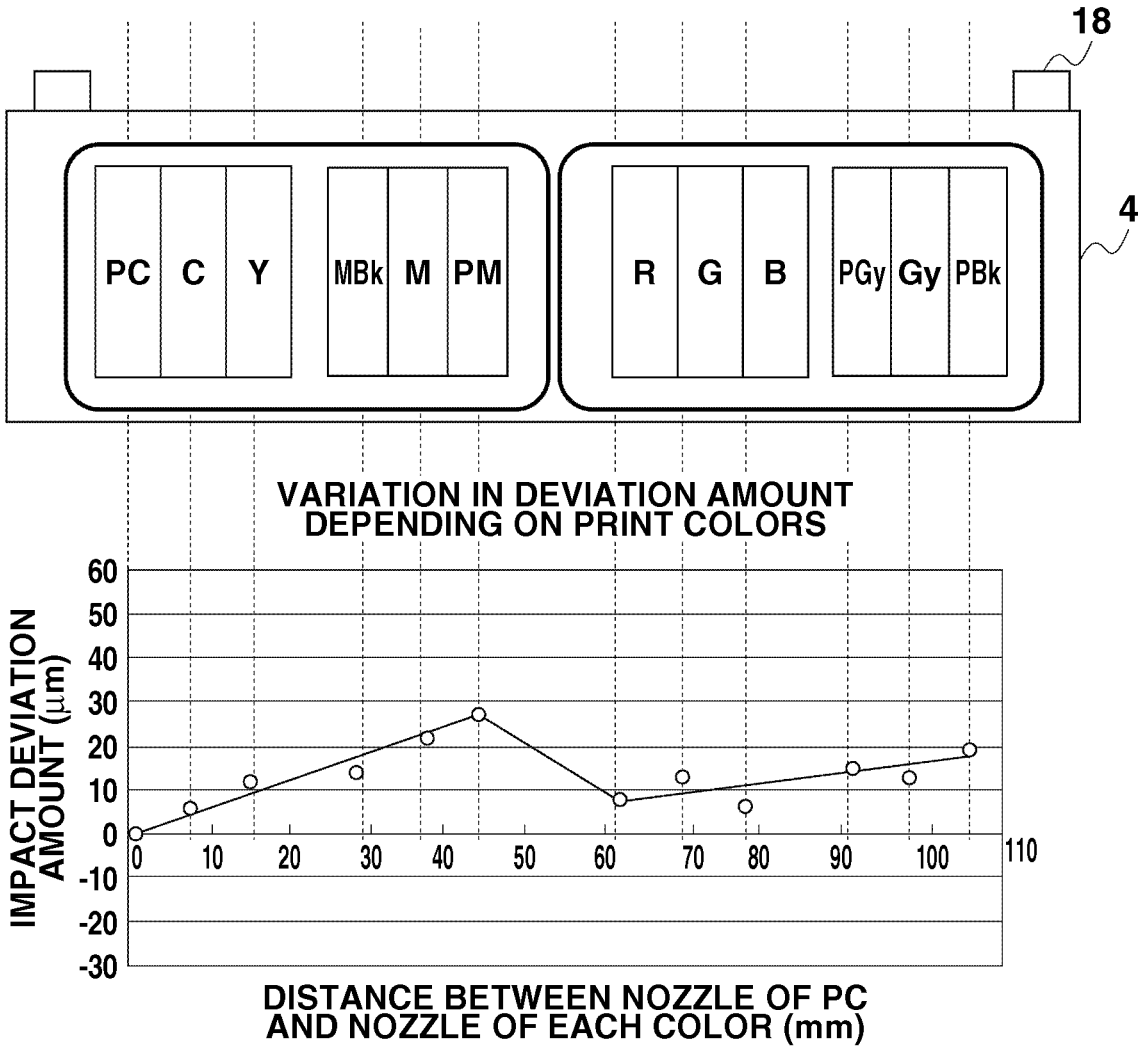
FIG. 8 illustrates the relationship between the nozzle position and the impact deviation.

FIG. 8 illustrates the relationship of the impact deviation amounts (in the conveyance direction) of the nozzle arrays based on the nozzle array PC. Since the carriage 4 is supported by rails at symmetry positions around the center thereof, the six colors at the right side and the six colors at the left side from the center of the carriage 4 have different tendencies about impact position deviations. In other words, an impact deviation amount caused by a change in the posture of the carriage 4 is changed in different manners between the right side and the left side of the center of the carriage 4. Especially, this influence is remarkable in a carriage in which there is a plurality of recording heads each including a plurality of colors integrally, and the distance between nozzle arrays are large, like the present exemplary embodiment. On the other hand, the impact deviation amount is changed in a similar manner in the nozzle arrays belonging to the right recording heads relative to the center of the carriage 4, and in the nozzle arrays belonging to the left recording heads based on the center of the carriage 4. This is because the carriage posture is determined relative to the center of the two support positions supported by the support members 18.

For example, there is six colors PM, M, MBk, Y, C, and PC at the left recording heads, and linear approximation can be substantially established among the deviation amounts of these six colors (refer to the lower graph of FIG. 8). Therefore, acquisition of the deviation amounts (adjustment values) can be easily completed by obtaining only the deviation amount between two colors PM and PC (i.e., the largest impact deviation amount in the recording range) with use of the adjustment patterns illustrated in FIG. 9, and obtaining the impact position deviation amounts of the other colors from calculation. The deviation amounts of the six colors belonging to the right recording heads can be acquired in the same manner.

FIG. 4 illustrates an example of the largest deviation amount in the conveyance direction and the impact position deviation profile with respect to the combinations of the eleven colors which are acquired by the above-described method, and indicates the inter-color deviation amounts in the conveyance direction in pixels. The impact deviation amount due to a change in the posture of the carriage 4 increases according to the increase in the distance between the nozzle arrays, and therefore, generally, the combination of the nozzle arrays PBk and PC situated at the outermost sides has the largest impact position deviation amount due to a change in the posture of the carriage 4. On the other hand, in comparison, the combination of two colors of adjacent nozzle arrays in a same recording head has a small deviation amount.

Next, in step S3-2, threshold values corresponding to the respective combinations of the colors are applied to the generated impact position deviation profile. In the present exemplary embodiment, 1.5 is set as the threshold value for a combination of two colors related to a light color or yellow, and 1.0 is set as the threshold value for a combination of the other colors. These threshold values are values set to determine whether an impact position deviation between colors is within an acceptable range. A small value (1.0) is set as the threshold value for a combination of frequently superimposed colors or a combination of conspicuous colors, thereby narrowing the acceptable range for the deviation amount therebetween to maintain high-quality image recording. The combination of frequently superimposed colors may be not only a combination of light colors but also a combination of dark colors.

FIG. 5 illustrates the result of the application of the threshold values corresponding to the respective combinations of the colors to the impact position deviation profile illustrated in FIG. 4. In FIG. 5, the combinations with a deviation amount equal to or larger than the threshold value therefor are surrounded by a thick frame. In the present exemplary embodiment, eleven combinations in total, including the combinations of PBk-PC, C, and M, exceed the threshold value.

Next, in step S3-3, each of the all combinations of the eleven colors is determined whether it has a deviation amount equal to or smaller than the threshold value therefor, or exceeding the threshold value therefor. As mentioned above, in the present exemplary embodiment, eleven combinations all exceed the threshold value therefor. If there is no combination that exceeds the threshold value, since the impact positions do not need to be adjusted, the controller 400 does not perform position adjustment in step S3-5. On the other hand, if a specific combination exceeds the threshold value therefor (YES in step S3-3), the adjustment priority order of this combination is changed, so that the impact position deviations can be optimally adjusted for all of the eleven colors.

Next, in step S3-4, a higher priority order is assigned to the combination exceeding the threshold value so that the adjustment value for this combination is preferentially determined. In the present exemplary embodiment, PBk is set as the reference color, and therefore, first, the adjustment values are determined for the combinations of PBk-cyan C, magenta M, and photo cyan PC which are the combinations exceeding the respective threshold values, out of the combinations including the reference color (PBk). Next, adjustment values are determined for the colors exceeding the threshold value based on the adjustment colors cyan C and magenta M. This is because priority is given to the basic colors (C, M, Y, and K) of color overprinting. The adjustment value for the color K out of these basic colors is most preferentially determined. The adjustment value for the color Y is less preferentially determined than the colors C and M due to its low visibility. Therefore, in the present exemplary embodiment, next, the adjustment value for the color Gy is determined based on the relationship of Gy to C and M, and then the adjustment value for B is determined based on the relationship of B to C and M. Further, the adjustment value for G is determined based on the relationship of G to C and M, and G, and then the adjustment value for R is determined based on the relationship of R to C and M.

Figure 16:
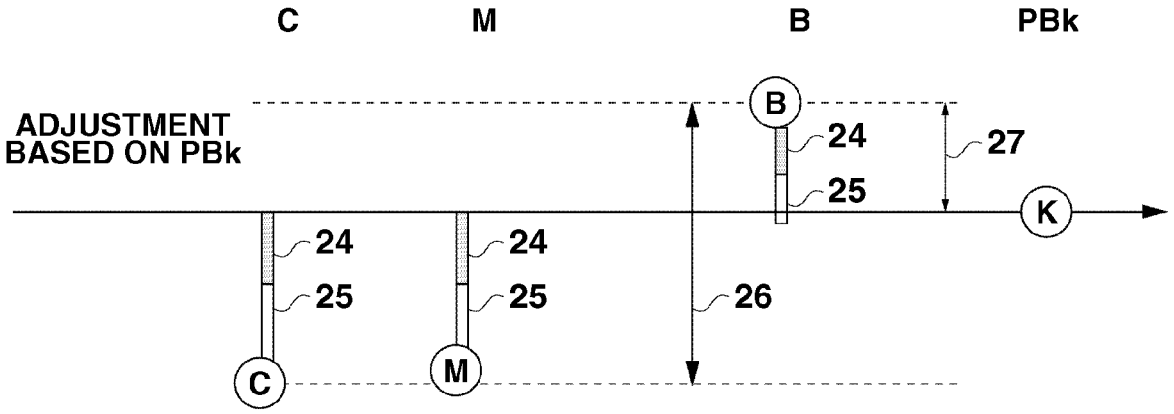
FIG. 16 schematically illustrates the relationship among impact positions of four colors.

Now, the adjustment value determination method will be described in further detail. FIG. 16 schematically illustrates the relationship among the impact positions of the four colors PBk, C, M, and B in the present exemplary embodiment. In FIG. 16, B is situated at a higher position than PBk located at the rightmost position, which indicates that the impact position of B deviates to the plus side relative to the impact position of PBk. On the contrary, C and M are situated at lower positions than PBk, which indicates that the impact positions of C and M deviate to the minus side relative to the impact position of PBk. Further, the deviation amounts of these colors relative to the reference color PBk each are divided into two components, a deviation amount 24, which is a deviation amount dependent on the nozzle array, and a deviation amount 25 which is the largest value in the impact position deviation amounts in the carriage scanning region. The deviation amount 24 dependent on the nozzle array varies depending on, for example, the manufacturing tolerances of the nozzle arrays of the respective colors. However, in the present exemplary embodiment, it is assumed that the respective colors have a same value as the deviation amount 24. On the other hand, the deviation amount 25, which is the largest value in the impact position deviation amounts in the carriage scanning region, is a deviation amount based on PBk, and increases according to the increase in the distance between the nozzle array of the color and the nozzle array of PBk. A largest deviation amount 26, which is the largest deviation amount in the combinations of the four colors (PBk, C, M, and B), is the deviation amount between C and B.

Figure 17:
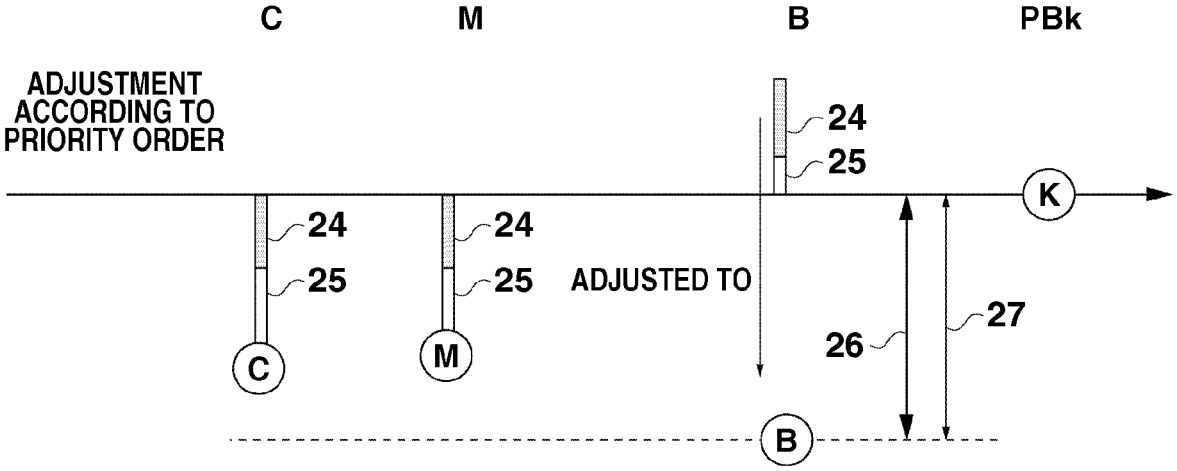
FIG. 17 schematically illustrates adjustment of impact positions while changing an adjustment order.

FIG. 17 illustrates the procedure for determining adjustment values according to the present exemplary embodiment. As described above, first, the adjustment of cyan C and magenta M is performed in terms of the relationship to the reference color (PBk). After that, the adjustment value of B is not determined so that the deviation amount thereof from PBk is reduced, but is determined so that the deviation amount thereof from C and M is reduced. In this case, since the adjustment value of B is set so that the impact position deviation amount is minimized in terms of the relationship to C and M, the impact position of B is adjusted as illustrated in FIG. 17. This adjustment rather makes the impact position deviation amount between PBk and B larger, but the total of the impact position deviation amounts in the combinations among PBk, C, M, and B is reduced compared to that illustrated in FIG. 16. In this way, the adjustment values are not determined in a predetermined fixed order, but are determined from the largest value of the impact position deviation amount in the carriage scanning region to which the deviation amount dependent on the nozzle arrays is reflected, whereby the impact position deviation amount in the all colors can be reduced.

On the other hand, in step S3-5, the impact positions are adjusted in a set normal order for the combinations that do not exceed the threshold value. In the present exemplary embodiment, this corresponds to determination of the adjustment values between the remaining colors and the reference color (PBk). In the present exemplary embodiment, the impact position adjustments are performed according to the following order.

(1) Adjust PBk-C, and determine the impact adjustment value of C.

(2) Adjust PBk-M, and determine the impact adjustment value of M.

(3) Adjust PBk-PC, and determine the impact adjustment value of PC.

(4) Adjust M-C-Gy, and determine the impact adjustment value of Gy.

(5) Adjust M-C-B, and determine the impact adjustment value of B.

(6) Adjust M-C-R, and determine the impact adjustment value of R.

(7) Adjust M-C-G, and determine the impact adjustment value of G.

(8) Adjust the remaining colors (PM, PGy, and Y) based on PBk (reference color).

FIG. 6 illustrates the inter-color deviation amounts adjusted by the above-described process flow. According to the present exemplary embodiment, assigning higher priority to the position adjustment for the combination of the colors having a large impact position deviation amount therebetween enables adjustment of the impact position deviations of the all colors while realizing proper balance, and improvement of the precision of the impact position deviation adjustment in the conveyance direction for the whole of the plurality of colors. The method for correcting the dot impact position in the conveyance direction may be embodied by shifting image data pixel by pixel in the conveyance direction according to the adjustment value or changing the used nozzle range as conventionally known, or may be embodied by any other correction method.

Figure 18:
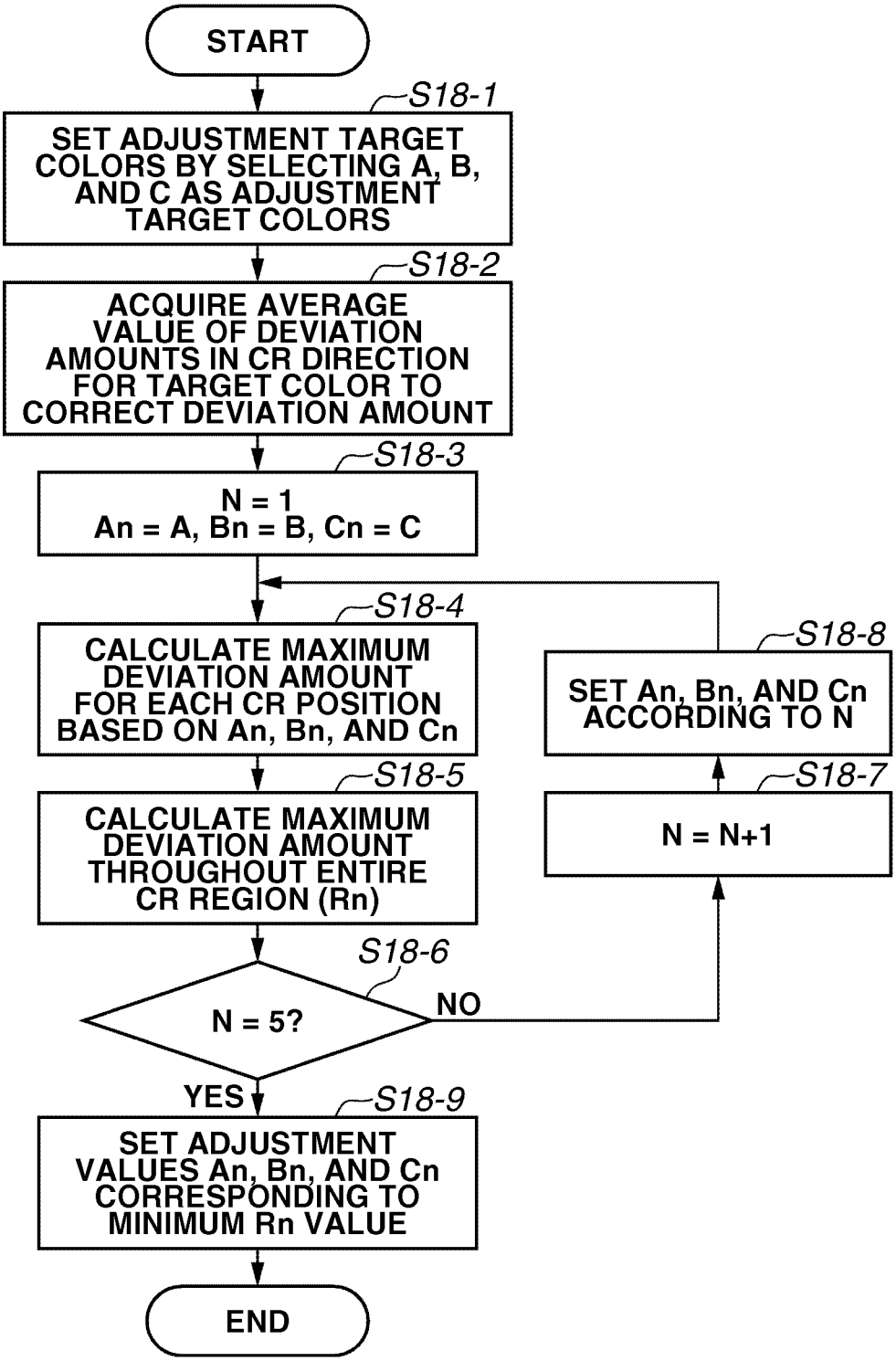
FIG. 18 is a flowchart for calculating adjustment values of adjustment target colors.

A concrete description will be given of the method for determining the impact position adjustment values for the plurality of colors that has been described above with reference to FIGS. 16 and 17. For simplification of description, this method will be described based on an example of determining the impact adjustment values for minimizing the impact position deviation among three colors. FIG. 18 illustrates a flowchart for calculating adjustment values of three colors.

First, in step S18-1, the controller 400 of the recording apparatus 2 sets adjustment target colors. In the present exemplary embodiment, the controller 400 sets A, B, and C as the adjustment target colors. If this flow process is applied to the example illustrated in FIGS. 16 and 17, the adjustment target colors A, B, and C correspond to C, M, and B. Further, out of the adjustment target colors, a color with the adjustment value set thereto in advance is selected as a reference color, and a color for which an adjustment value is determined by this processing is selected as an adjustment color. In the example indicated in the flowchart of FIG. 3, the reference color is C and M for which the adjustment values have been already determined in terms of their relationships to the reference color (PBk), and the adjustment color is B for which the adjustment value is determined in terms of its relationship to C and M. However, aside from this example, in the following description, it is assumed that there is one reference color (reference color 1) and two adjustment colors (adjustment color 1 and adjustment color 2). In should be noted that, even same colors can be processed in the manner which will be described below by handling them as different colors in the present processing, as long as those same colors have nozzle arrays disposed at different positions in the carriage.

Next, in step S18-2, the controller 400 acquires an average deviation value of the adjustment target color in the carriage direction (CR direction). Then, the controller 400 determines the adjustment value based on the average deviation value, and corrects the position.

More specifically, the controller 400 calculates an average value of the deviation amounts in the entire region of the CR direction for each color. This can be performed by calculating an average of the deviation amounts measured at a plurality of positions in the CR direction as indicated in FIG. 9. Then, the controller 400 calculates the impact position of each of the reference color, the adjustment color 1, and the adjustment color 2 when the adjustment value for the average deviation amount is applied thereto. Since the applied impact adjustment value is based on the unit of nozzle resolution (1200 dpi: 21 μm in the present exemplary embodiment), the average adjustment value rarely becomes "0" relative to the reference color.

Figure 10:
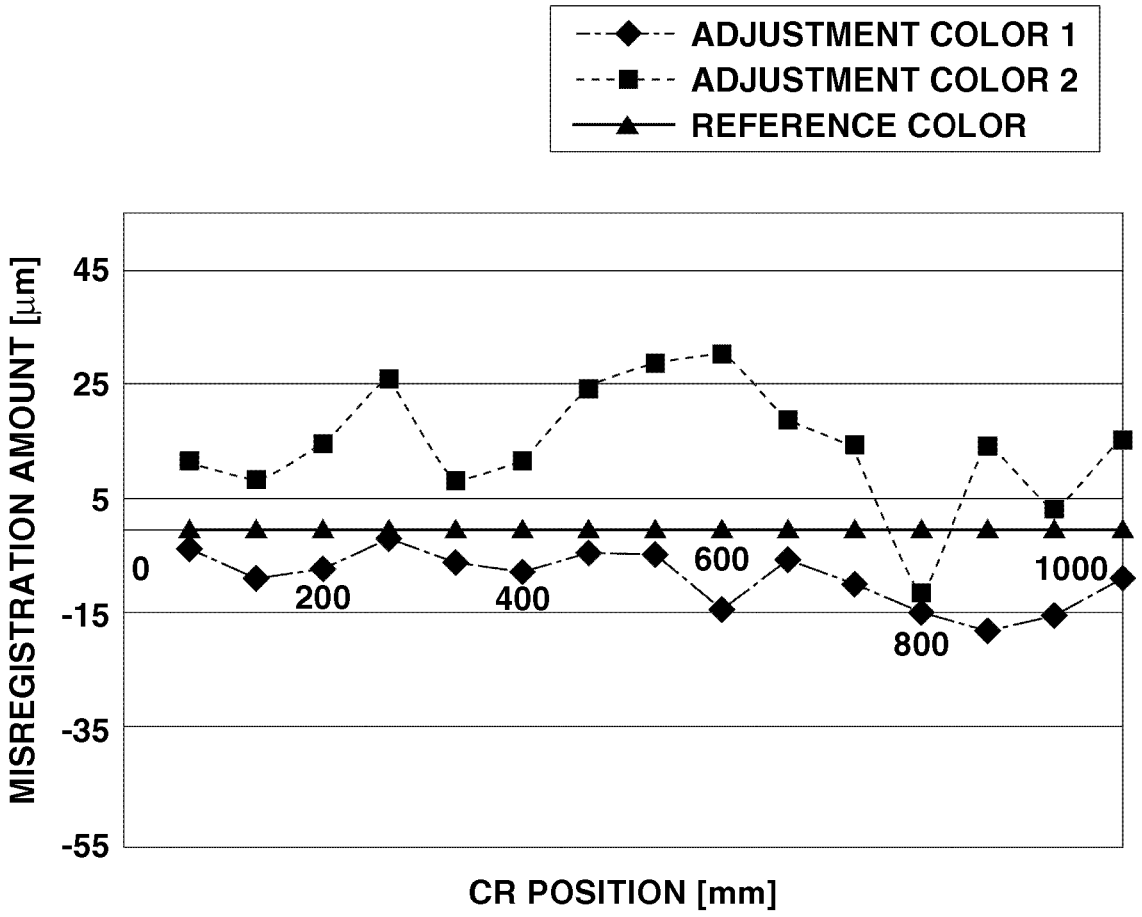
FIG. 10 illustrates changes in the impact position deviation amounts to which adjustment values based on a reference color are applied.

FIG. 10 illustrates impact position deviation amounts after the measurement of the impact position deviation for each of the plurality of points in the scanning region and application of the impact adjustment value using the average adjustment value. In the present exemplary embodiment, the deviation amount of each color relative to the reference color can be minimized by determining the adjustment value so as to minimize its deviation of the average value of the impact position deviation amounts in the carriage scanning region. For example, the largest deviation amount between the reference color and the adjustment color 1 is approximately 30 μm measured at around the CR position 600 mm. Further, the largest deviation amount between the reference color and the adjustment color 2 is approximately 20 μm measured at around the CR position 850 mm. For simplification of description, it is assumed that there is no change in the deviation amount of the reference color in the CR direction.

Next, in step S18-3, the controller 400 calculates the deviation amounts of the adjustment target colors A, B, and C in an initial state, i.e., when only the adjustment value based on the reference color is applied thereto. More specifically, the controller 400 uses a variable N, and sets 1 as N, A as An, B as Bn, and C as Cn (N=1, An=A, Bn=B, and Cn=C). An, Bn, and Cn represent the adjustment values of the respective colors. A is the impact deviation amount of the reference color for each carriage position, B is the impact deviation amount of the adjustment color 1 for each carriage position, and C is the impact deviation amount of the adjustment color 2 for each carriage position. In other words, this is the state that the adjustment value calculated only in consideration of a single deviation amount of the color is set to each color.

Next, in step S18-4, the controller 400 calculates the largest deviation amount for each CR position with respect to An, Bn, and Cn. In the example illustrated in FIG. 10, for example, at the CR position 200 mm, the combination having the largest deviation amount among the three colors is the combination of the adjustment color 1 and the adjustment color 2, and the deviation amount thereof is approximately 22 μm. On the other hand, at around the CR position 800 mm, the combination having the largest deviation amount at this position is the combination of the reference color and the adjustment color 1, and the deviation amount thereof is approximately 19 μm. In this way, the combination having the largest deviation amount is different depending on the CR position, and the largest deviation amount is calculated for each position.

Next, in step S18-5, the controller 400 calculates the largest deviation amount (Rn) throughout the entire CR region. In the example illustrated in FIG. 10, the largest deviation amount is the deviation between the adjustment color 1 and the adjustment color 2 around the CR position 600 mm, and that amount is approximately 45 μm.

Next, in step S18-6, it is determined whether N is equal to 5 (N=5). If N is not equal to 5 (NO in step S18-6), the processing proceeds to step S18-7 in which N is incremented by 1, and then the processing returns to step S18-4. This is because, in this process flow, cases N=1 to 5 are prepared, and the largest deviation amount is calculated for each of the cases. The cases N=1 to 5 are prepared as follows. In the case of N=1, An=A, Bn=B, and Cn=C. In the case of N=2, An=A, Bn=B+1, and Cn=C. In the case of N=3, An=A, Bn=B, and Cn=C+1. In the case of N=4, An=A, Bn=B−1, and Cn=C. In the case of N=5, An=A, Bn=B, and Cn=C−1.

The number "1", which is added to or subtracted from B or C in the above equations, corresponds to the adjustment resolution of the impact position adjustment (1200 dpi: 21 μm).

In other words, according to this process flow, in the case of N=1, the controller 400 calculates the largest impact position deviation amount among the adjustment target colors in the initial state (the adjustment value is determined only in consideration of the deviation of each color). Further, in the case of N=2, the controller 400 calculates the largest impact position deviation amount in such a state that the adjustment value of +1 is applied to the color B (adjustment color 1) out of the adjustment target colors 3. Similarly, the controller 400 can calculate the largest deviation amount in such a state that the adjustment value of +1 or −1 is applied to B (adjustment color 1) or C (adjustment color 2). In this way, in step S18-4, the controller 400 calculates the largest deviation amount for each CR position with respect to An, Bn, and Cn in the all cases except for the case of N=1 (step S18-5).

Figure 11:
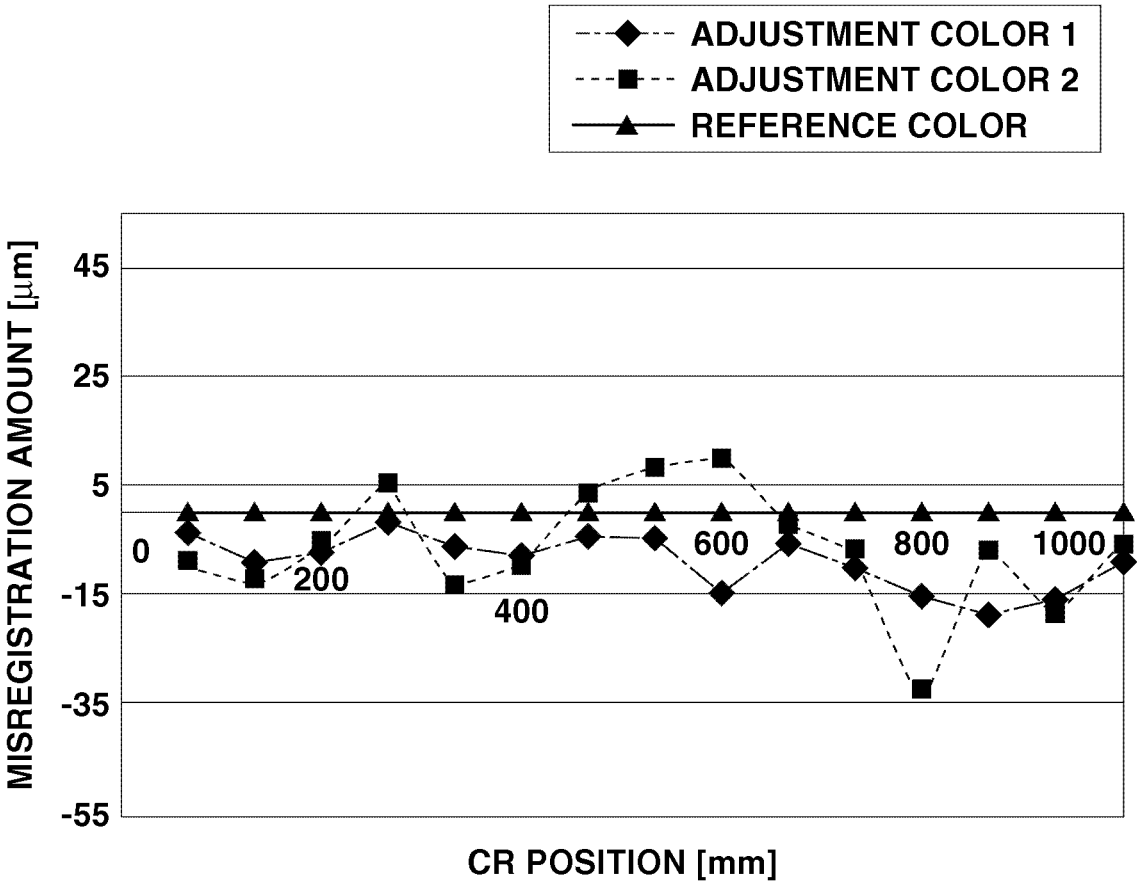
FIG. 11 illustrates changes in the impact position deviation amounts to which adjustment values based on an average of a plurality of colors are applied.

FIG. 11 illustrates the impact position deviation amounts of the respective colors in the case of N=5 (An=A, Bn=B, and Cn=C−1). In this case, the combination having the largest deviation amount at the CR position 600 mm is the combination of the adjustment color 1 and the adjustment color 2. On the other hand, around the CR position 800 mm, the combination having the largest deviation amount is the combination of the reference color and the adjustment color 2. In the example illustrated in FIG. 11, the largest deviation amount is approximately 35 μm in the combination of the reference color and the adjustment color 2 around the CR position 800 mm. This indicates that the deviation amount of the adjustment color 2 relative to the reference color increases compared to the example illustrated in FIG. 10, but in terms of the combination of the three colors, the largest deviation amount among the colors is smaller in a case of the impact adjustment value of FIG. 11 compared to the example illustrated in FIG. 10.

In step S18-9, the controller 400 sets the adjustment values An, Bn, and Cn that provide the smallest Rn. In this example, the largest deviation amount Rn is 35 μm when N is 5, and this is smaller than those when N is 1 or the other numbers. Therefore, in this case, the controller 400 selects the adjustment values An=A, Bn=B, and Cn=C−1 that realize the smallest impact deviation amount to the all of the combinations among the three adjustment target colors throughout the entire carriage scanning region.

In this way, in terms of the impact position deviation amount among a plurality of colors and for each carriage position, the optimum impact adjustment value is not necessarily the value which minimizes the deviation amount of each color relative to the reference color. In other words, adjustment of a plurality of colors based on the reference color may deteriorate the impact position deviation among the plurality of colors. When the adjustment values are determined according to the present exemplary embodiment, all of the adjustment target colors (three colors in the present exemplary embodiment) can be adjusted to reduce the deviation amount.

As mentioned above, in the present exemplary embodiment, the deviation amounts of the respective combinations of the plurality of nozzle arrays are compared to the threshold value. Then, the adjustment value for the combination exceeding the threshold value is preferentially determined, whereby the total of the deviation amounts among the plurality of nozzle arrays can be reduced. Further, as illustrated in FIG. 18, to the determine the adjustment values for the plurality of nozzle arrays, the respective adjustment values are determined so that the total of the impact position deviations among the plurality of nozzle arrays can be minimized. As a result, it is possible to set the adjustment values that can minimize the deviation among the plurality of colors in the conveyance direction.

Other Embodiments

Figure 13:
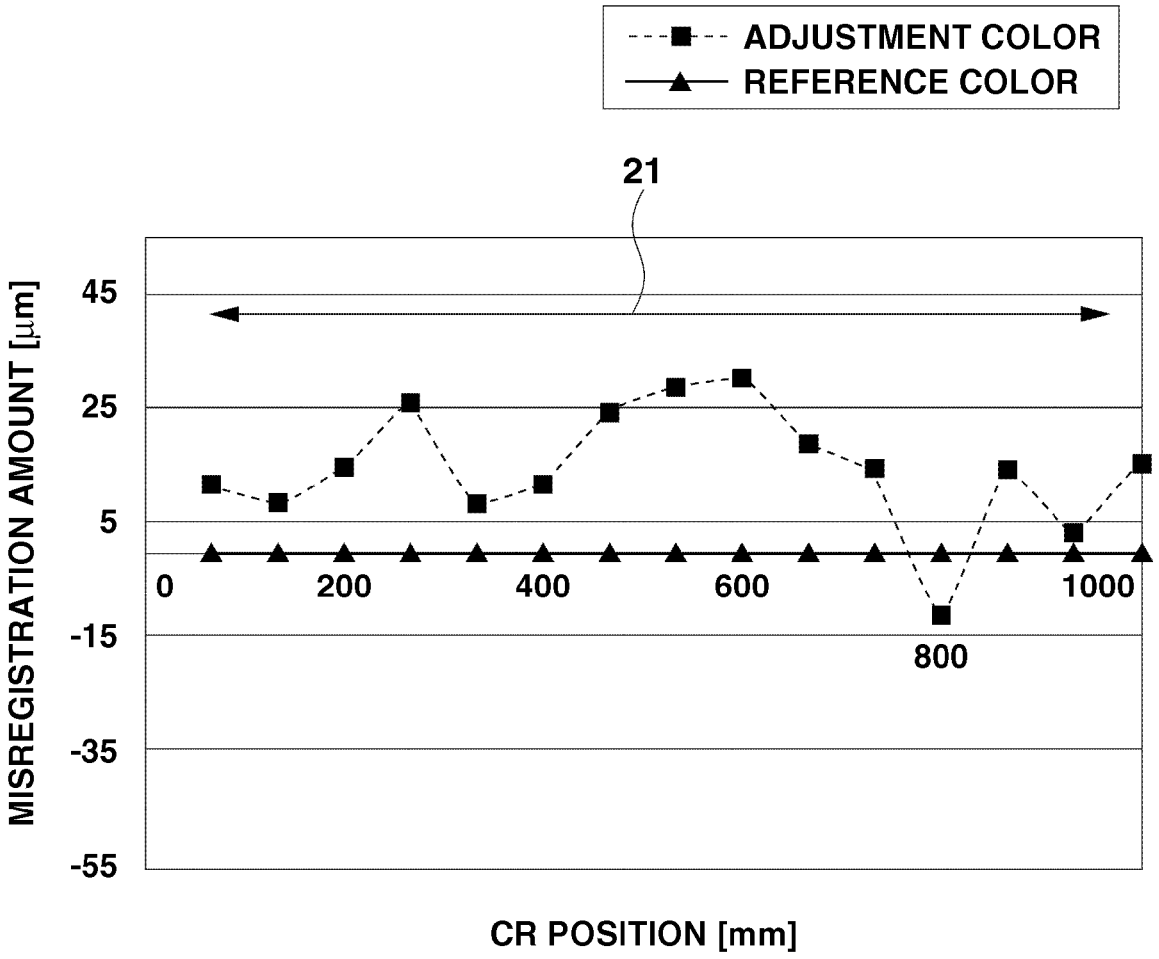
FIG. 13 illustrates a change in an impact position deviation amount in a carriage direction.

The adjustment values acquired in the above-mentioned manner are basically determined based on the impact deviation amounts throughout the entire carriage region and the combinations of the ink colors. However, if there is a change in the recording range where the carriage is driven to perform scanning for recording (for example, the size of a recording medium is changed), the adjustment values may be changed according to the print region. FIG. 13 illustrates the relationship of the impact positions of the two colors, i.e., the reference color and the adjustment color, after the application of the impact adjustment so that the impact position deviation therebetween can be minimized throughout the enter carriage scanning region. In FIG. 13, there is a singular point (inflection point) around the carriage position 800 mm from the reference side. However, except around the carriage position 800 mm, the impact position deviation is almost entirely situated at the plus side. In the present exemplary embodiment, the largest deviation amount is approximately 30 μm around the carriage position 600 mm.

Figure 14:
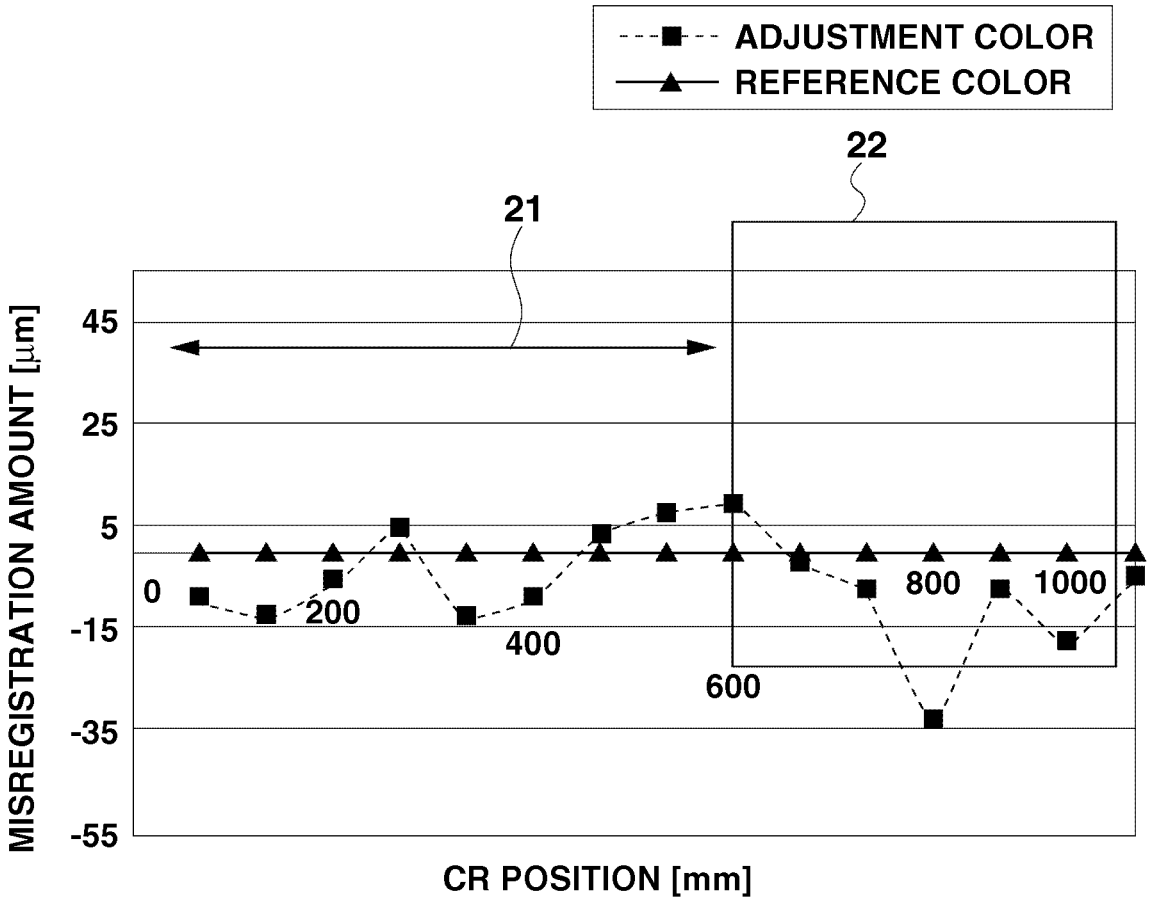
FIG. 14 illustrates a change in an impact position deviation amount in a limited print region.
Figure 15:
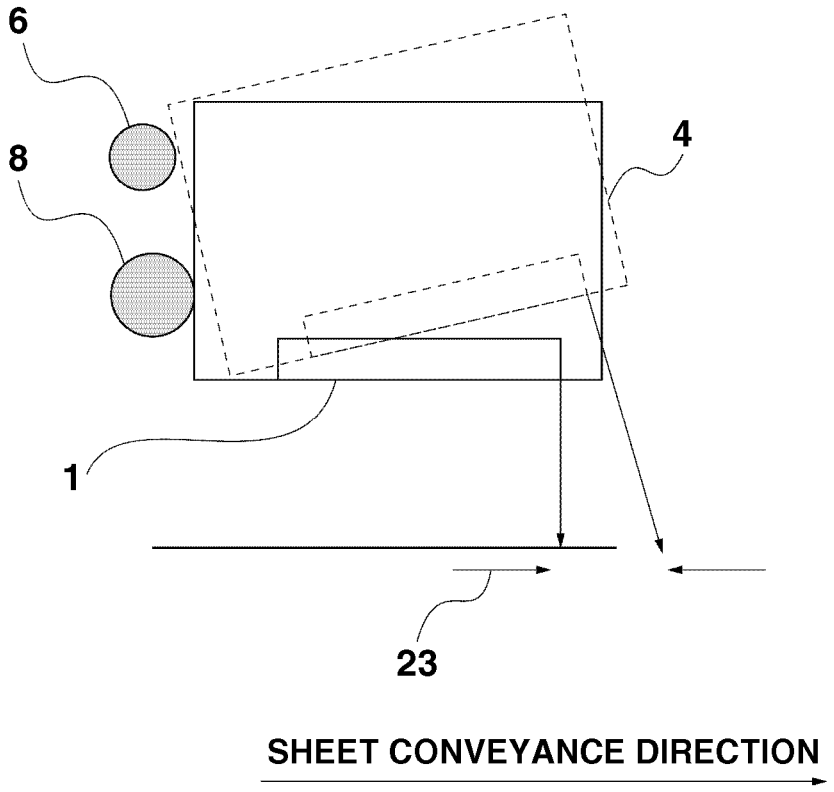
FIG. 15 illustrates a change in the posture of a carriage.

On the other hand, FIG. 14 illustrates the relationship of the impact positions of the two colors, i.e., the reference color and the adjustment color, after the application of the impact adjustment using a different adjustment value than the adjustment value of FIG. 13 so that the impact position deviation therebetween can be minimized in a limited print region. In this exemplary embodiment, the range 600 mm is set as the print range. As illustrated in FIG. 14, since the carriage operates comparatively smoothly from the print start position to around the center, when the print region is only around half the entire region, it is possible to reduce the impact deviation amount by re-calculating the adjustment value separately from the calculation when the print region is the entire region. In the present exemplary embodiment, newly setting the adjustment value can reduce the largest deviation amount to approximately 15 μm around the carriage position 150 mm. The print region may be determined based on the size of a recording medium. Further, with use of the print character width of the image, the print region can be more accurately determined even for recording media having a same size.

Further, in the above description, the deviation amount in the conveyance direction is determined with use of the pattern. However, since the deviation in the conveyance direction is mainly caused by a change in the posture of the carriage, the deviation amount of the recording position may be estimated by directly detecting a change in the carriage rail.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

What is claimed is:

1. An inkjet recording apparatus configured to perform recording on a recording medium by a recording head, at which a plurality of nozzle arrays each discharging a different type of ink are arranged in a predetermined direction, to perform scanning in a scanning direction along with the predetermined direction while conveying the recording medium in a conveying direction which intersects the predetermined direction, the inkjet recording apparatus comprising:

an acquisition unit configured to acquire information relating to a relative deviation amount of a recording position in the conveying direction among each of the plurality of nozzle arrays; and a setting unit configured to set an adjustment amount for adjusting the recording position of the nozzle array of the plurality of nozzle arrays in the conveying direction based on the relative deviation amount indicated by the information acquired by the acquisition unit, wherein the setting unit sets the adjustment amount for adjusting the recording position of a first nozzle array by using a predetermined nozzle array of the plurality of nozzle arrays as a reference for the adjusting and sets the adjustment amount for adjusting the recording position of a second nozzle array of the plurality of nozzle arrays based on the set adjustment amount of the first nozzle array.

2. The inkjet recording apparatus according to claim 1, wherein the acquisition unit comprises a generation unit configured to generate patterns with use of the plurality of nozzle arrays, and an optical detection unit configured to detect optical information of the plurality of patterns.

3. The inkjet recording apparatus according to claim 1, wherein the setting unit sets the adjustment value for minimizing the deviation amount at the plurality of positions in the conveying direction for all combinations of the nozzle arrays exceeding a threshold value.

4. The inkjet recording apparatus according to claim 1, wherein the acquisition unit acquires the information relating to the relative deviation amount of the recording position based on the relative deviation among each of the plurality of nozzle arrays at a plurality of positions in the scanning direction.

5. The inkjet recording apparatus according to claim 4, wherein the setting unit changes the adjustment value according to a recording range of the recording head in the scanning direction.

6. The inkjet recording apparatus according to claim 1, wherein the setting unit sets the adjustment amount for adjusting the recording position of the first nozzle array so that a deviation amount in recording position between the predetermined nozzle array and the first nozzle array is reduced, and sets the adjustment amount of the second nozzle array so that a deviation amount in recording position between the first nozzle array and the second nozzle array, in a case where the adjusting of the recording position of the first nozzle array has been performed with the set adjustment amount, is reduced.

7. The inkjet recording apparatus according to claim 1, wherein the setting unit sets the adjustment amount for adjusting the recording position of the first nozzle array and a third nozzle array of the plurality of nozzle arrays by using the predetermined nozzle array as a reference for the adjusting.

8. The inkjet recording apparatus according to claim 7, wherein the setting unit sets the adjustment amount for adjusting the recording position of the second nozzle array of the plurality of nozzle arrays based on the set adjustment amount of the first nozzle array and the third nozzle array.

9. The inkjet recording apparatus according to claim 7, wherein the setting unit sets the adjustment amount for adjusting the recording position of the first nozzle array and the third nozzle array by taking a predetermined length in a conveying direction as a unit for adjustment, such that the largest relative deviation between two nozzle arrays among the relative deviations between two arrays among the first array, third array and the predetermined nozzle array becomes smallest.

10. The inkjet recording apparatus according to claim 7, wherein the setting unit sets the adjustment amount for adjusting the recording position of a fourth nozzle array of the plurality of nozzle arrays based on the adjustment amount of the third nozzle array set by the setting unit.

11. An inkjet recording apparatus configured to perform recording on a recording medium by a recording head, at which a plurality of nozzle arrays each discharging a different type of ink are arranged in a predetermined direction, to perform scanning in a scanning direction along with the predetermined direction while conveying the recording medium in a conveying direction which intersects the predetermined direction, the inkjet recording apparatus comprising:

an acquisition unit configured to acquire information relating to a relative deviation amount of a recording position in the conveying direction among each of the plurality of nozzle arrays; and a setting unit configured to set an adjustment amount for adjusting the recording position of the nozzle array of the plurality of nozzle arrays in the conveying direction based on the relative deviation amount indicated by the information acquired by the acquisition unit, wherein the setting unit sets the adjustment amount for adjusting the recording position of a first nozzle array by using a predetermined nozzle array of the plurality of nozzle arrays as a reference for the adjusting and sets the adjustment amount for adjusting the recording position of a second nozzle array of the plurality of nozzle arrays based on the set adjustment amount of the first nozzle array, wherein the setting unit sets the adjustment amount for adjusting the recording position of the first nozzle array and a third nozzle array of the plurality of nozzle arrays by using the predetermined nozzle array as a reference for the adjusting, and wherein the setting unit sets the adjustment amount for adjusting the recording position of the first nozzle array and the third nozzle array by taking a predetermined length in a conveying direction as a unit for adjustment, such that the largest relative deviation between two nozzle arrays among the relative deviations between two arrays among the first array, third array and the predetermined nozzle array becomes smallest.

12. The inkjet recording apparatus according to claim 11, wherein the predetermined nozzle array is a nozzle array for discharging black ink, the first nozzle array is a nozzle array for discharging cyan ink, and the second nozzle array is a nozzle array for discharging blue ink.

13. The inkjet recording apparatus according to claim 12, wherein the third nozzle array is a nozzle array for discharging magenta ink.

14. The inkjet recording apparatus according to claim 12, wherein the fourth nozzle array is a nozzle array for discharging red ink.

* * * * *